US005127524A

United States Patent [19]

Howitt

[11] Patent Number: 5,127,524

[45] Date of Patent: Jul. 7, 1992

[54] STORAGE BIN

[75] Inventor: Robert T. Howitt, Leominster, Mass.

[73] Assignee: Frem Corporation, Worcester, Mass.

[21] Appl. No.: 571,243

[22] Filed: Aug. 22, 1990

[51] Int. Cl.[5] ..... B65D 25/22

[52] U.S. Cl. ..... 206/509; 220/23.83; 220/337; 220/908

[58] Field of Search ..... 206/509, 510; 220/23.4, 220/23.6, 23.83, 94 R, 908, 337, 338; 211/126

[56] References Cited

U.S. PATENT DOCUMENTS 2,774,511 12/1956 Menkin et al. ..... 220/94 R X
3,347,394 10/1967 Gould ..... 206/509 X
4,325,492 4/1982 Kunze ..... 220/908 X
4,550,837 11/1985 Simmons ..... 206/509 X
4,558,799 12/1985 Hammond ..... 220/337 X
4,749,101 6/1988 Durkan, Jr. ..... 220/337
4,984,704 1/1991 O'Malley ..... 220/23.83 X

*Primary Examiner*—Steven M. Pollard
*Attorney, Agent, or Firm*—Blodgett & Blodgett

[57] ABSTRACT

A stacking and nesting storage bin which has an open top and supporting elements such as a pair of legs which extend from one side wall of the bin at a downward angle to permit the bin to assume a tilted position so that the top opening faces forwardly and upwardly. A plurality of bins of the present invention can be stacked vertically one on top of the other so that the top opening of each bin faces forwardly and upwardly and is fully exposed and unencumbered by a bin which is located above or below.

7 Claims, 9 Drawing Sheets

STORAGE BIN

BACKGROUND OF THE INVENTION

The present invention relates generally to a storage bin and relates specifically to a stacking and nesting storage bin.

Stacking and nesting storage bins of various types have been used commercially and domestically for storing and displaying a wide range of items. The stacking feature of the bins maximizes the use of available space for holding merchandise for commercial use and for holding household items for domestic use. The nesting feature of the bins greatly reduces the shipping bulk to stores where they are sold to customers or used commercially by the store. This nesting feature also provides a substantial saving in warehouse storage space and floor space in stores where the bins are displayed and sold.

When stacking and nesting bins are employed in a stacking mode, the bins are stacked vertically one on top of the other for stability. Generally, the upper and lower edges of the bins are provided with interlocking elements for maintaining the bins in a stable condition when stacked. If the bin has four vertical sides only the items in the uppermost bin are accessible. This is acceptable if the bins are used to store like items. When all of the items in the uppermost bin are removed the uppermost bin is removed from the stack to expose the top of the next uppermost bin and to make the items in the next uppermost bin readily accessible. When the stack of bins is utilized to store a variety of different items, a three sided bin is used which provides a side opening to each bin in the stack so that the items in each bin of the stack can be reached for removal. However, this is not an ideal way to display items. Customers are conditioned to seeing items on open shelves or open top containers. Product visibility is a very important factor in retail marketing. Many items are purchased on impulse. In order for this to occur, the item must be prominently displayed or at least clearly visible and readily accessible. This is not the case with prior art storage bins.

As a rule, stacking and nesting storage bins have not been used as trash receptacles. The typical trash receptacle is a single, large, open top container which can be readily filled and emptied of trash. When items are thrown away they are literally thrown into a trash receptacle. The typical trash receptacle tapers inwardly from top to bottom which enables a plurality of receptacles to be nested. This tapering also enables a plastic liner to be used with the receptacle. When the receptacle is filled with trash, the plastic liner is removed along with the trash. The tapered shape of the receptacle enables the trash-filled liner to be removed easily. As the problems of dealing with society's waste becomes more acute, more and more waste products are being recycled. The need to divide trash into specific categories is becoming increasingly more essential. In order to deal with this problem, several trash receptacles must be used, one for each category of trash. This means that more floor space must be used for the accumulation of trash. This is true for domestic as well as commercial handling of trash. For example, in redemption centers for cans and bottles, each brand of bottle or can requires its own receptacle so that dozens of containers or receptacles are required. Three-sided stackable containers can be used for sorting trash, but they are awkward to use particularly in a commercial setting where time adds considerably to the cost of doing business. Also, it is extremely difficult to use liners with this type of bin or receptacle. It is very difficult to remove the trash-filled liner from the open side of the bin. In addition, most bins of this type are provided with a lip or short wall at the side opening to prevent items from spilling out of the bin which makes it extremely difficult if not impossible to remove a trash-filled liner from the bin without disturbing the entire stack of bins.

Still other prior art bins or containers have separating means for dividing the container into a plurality of compartments. This either limits the capacity of each compartment or results in a container which is large and awkward to handle and requires as much floor space as the use of a plurality of individual containers. These and other difficulties experienced with the prior art storage bins have been obviated by the present invention.

It is, therefore, a principal object of the invention to provide an open top storage bin in which the open top of each bin in the stack is exposed and readily accessible for putting items into the bin and taking items out of the bin.

Another object of this invention is the provision of an open top stacking storage bin in which the open top of each bin in the stack is exposed and in which the bins are capable of nesting.

A further object of the present invention is the provision of a open top stacking storage bin in which the open top of each bin in the stack is exposed and a plurality of bins can be nested without jamming.

It is another object of the instant invention to provide an open top stacking storage bin which can be supported and stacked so that the open top of each bin faces forwardly and upwardly to provide maximum accessibility to the interior area of each bin.

A still further object of the invention is the provision of an open top stacking storage bin in which a plurality of bins can be supported and stacked so that the top opening of each bin faces forwardly and upwardly and in which each bin is provided with a pivoted cover which can be moved to an the open position in which the cover is substantially horizontal and below the top opening of the bin to act as a guide for items being deposited in the bin and to prevent spillover of items inside the bin.

It is a further object of the invention to provide an open top nesting storage bin which can be stacked with identical bins when stacked to provide a plurality of readily accessible trash containers for enabling trash to be sorted into several categories wherein each bin is capable of being lined with a plastic bag prior to being filled and which allows the bag to be readily removed from the bin after the bag has been filled with trash.

It is a further object of the invention to provide a open top stacking and nesting storage bin which is easy to stack and easy to use for a wide range of purposes such as storing, displaying, or sorting diverse items.

With these and other objects in view, as will be apparent to those skilled in the art, the invention resides in the combination of parts set forth in the specification and covered by the claims appended hereto.

SUMMARY OF THE INVENTION

In general, the invention consists of a stacking and nesting storage bin which in is a bottom wall and a plurality of side walls which define a generally rectangular open top and a pair of legs which extend forwardly and downwardly from one of the side walls of the bin, thus supporting the bin in a partially tipped position so that the top opening faces forwardly and upwardly. More specifically, each bin has a pair of slots for receiving the legs of a similar bin so that a plurality of bins can be stacked vertically and the open top of each bin is exposed and readily accessible.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 4:
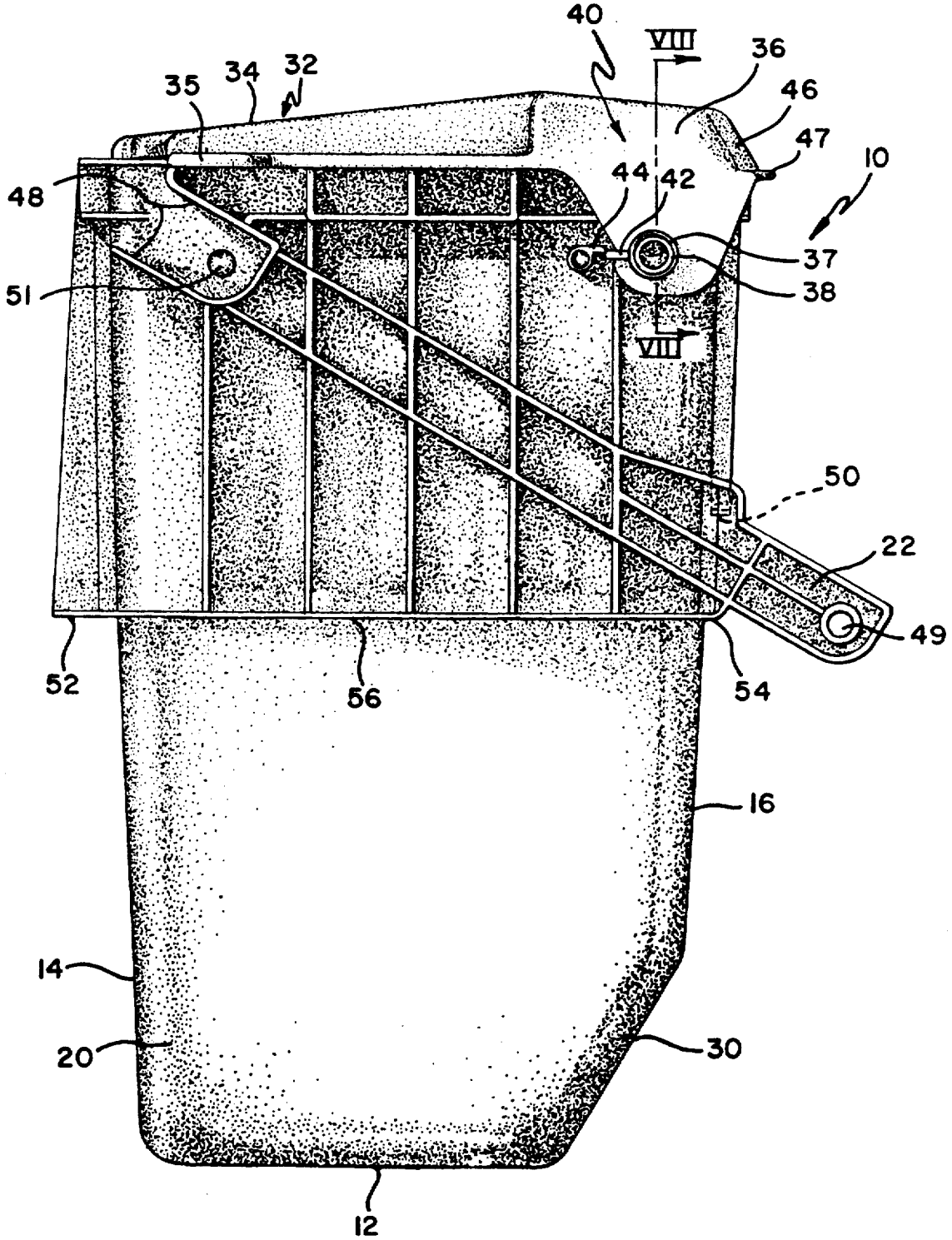
FIG. 4 is a left side elevational view of the bin.

Referring first to FIGS. 1–6 the nestable and stackable storage bin of the present invention is generally indicated by the reference numeral 10 and consists of a generally rectangular box-like structure with an open top and a pivoted cover. The bin 10 comprises a bottom wall 12, a back wall 14, a front wall 16, a left side wall 20, and a right side wall 18. The front, back, and side walls of the bin extend upwardly from the bottom wall 12 at a slight outward angle and terminate in a top edge 26 which defines a top opening 28. A left leg 22 extends forwardly from the left side wall 20 at a downward angle as shown in FIG. 4. A right leg 24 extends forwardly and downwardly from the right side wall 18. The lower front corner between the bottom wall 12 and the front wall 16 is truncated and consists of a corner surface 30. When the storage bin 10 is positioned in its normal operating state as shown in FIG. 10, the legs 22 and 24 rest on a flat supporting surface and the corner surface 30 lies flush with the supporting surface.

Figure 5:
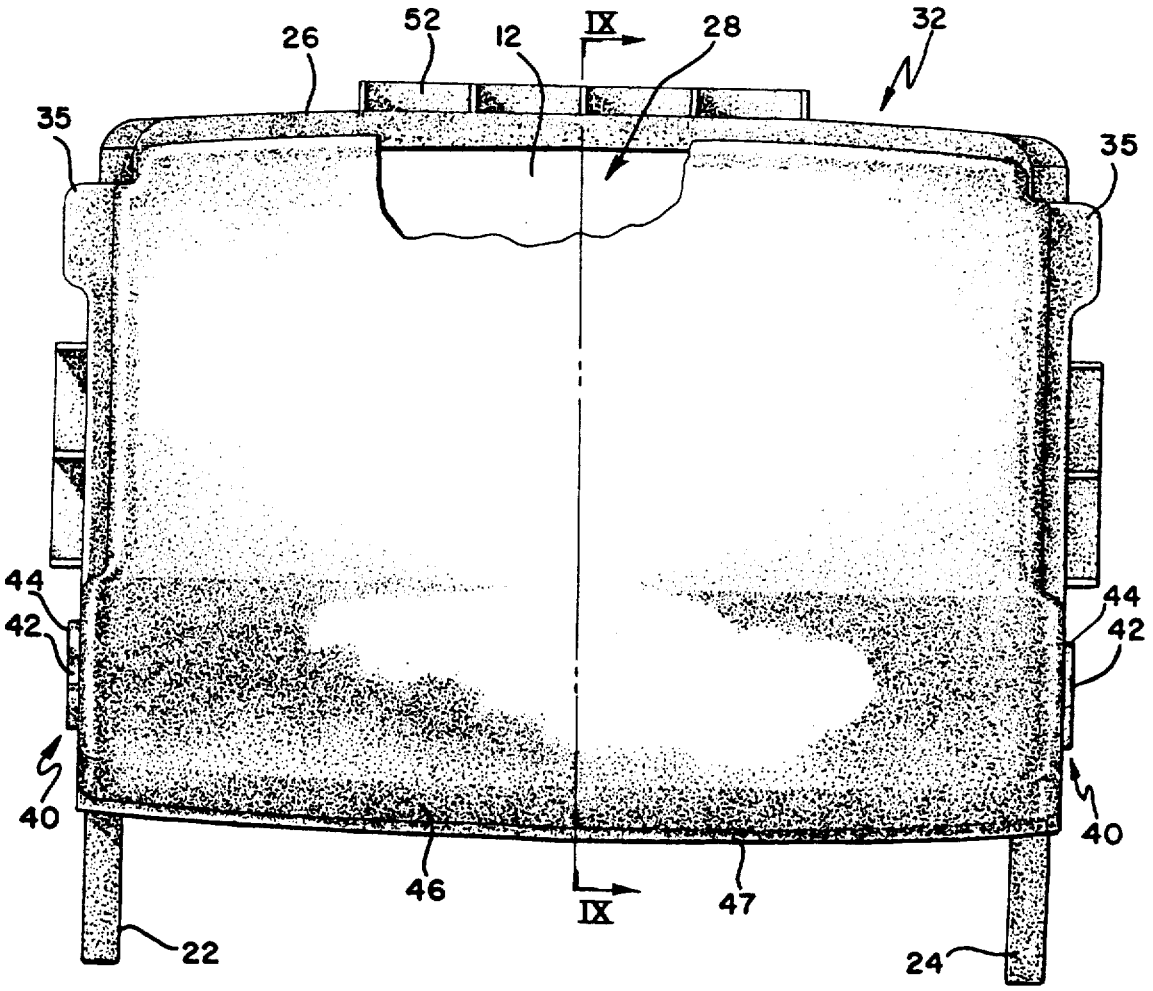
FIG. 5 is a top plan view of the bin.
Figure 6:
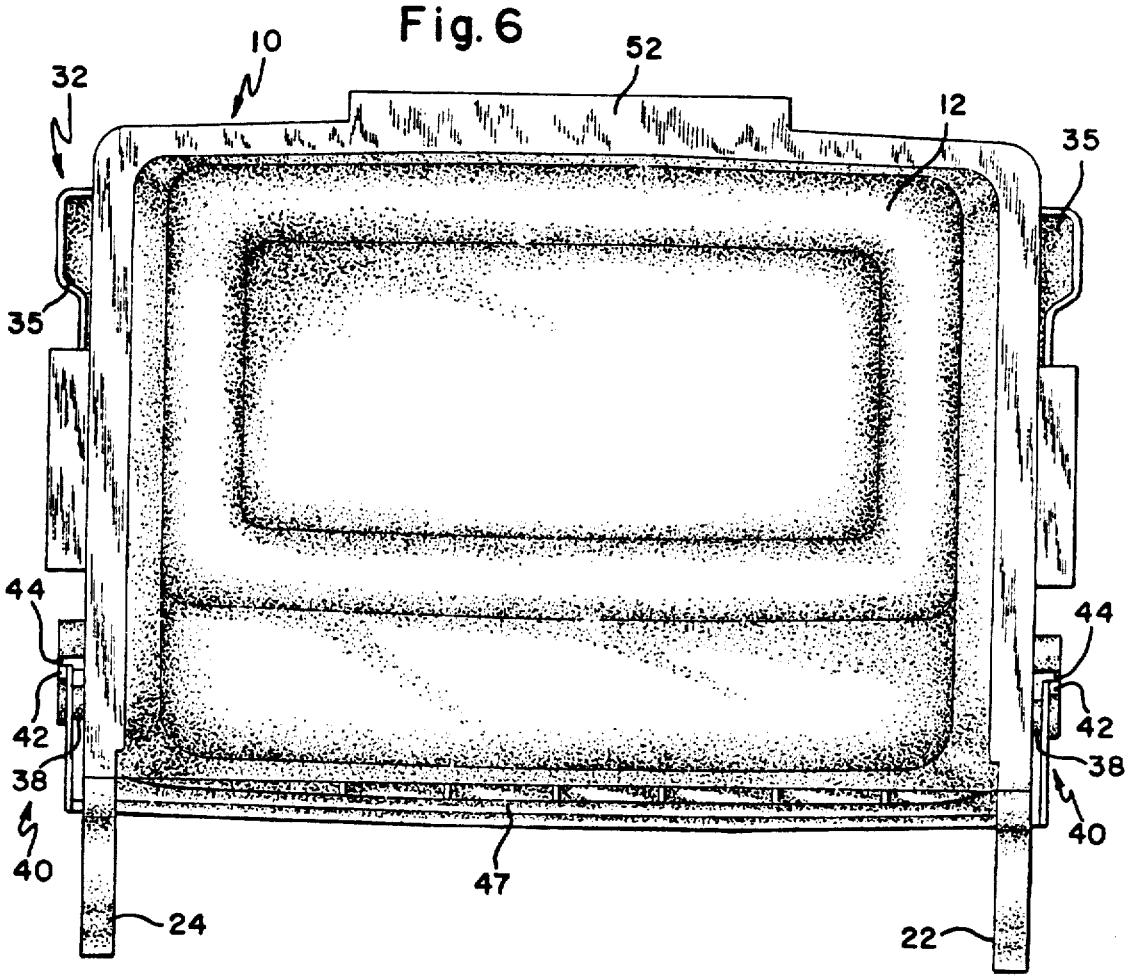
FIG. 6 is a bottom plan view of the bin.
Figure 7:
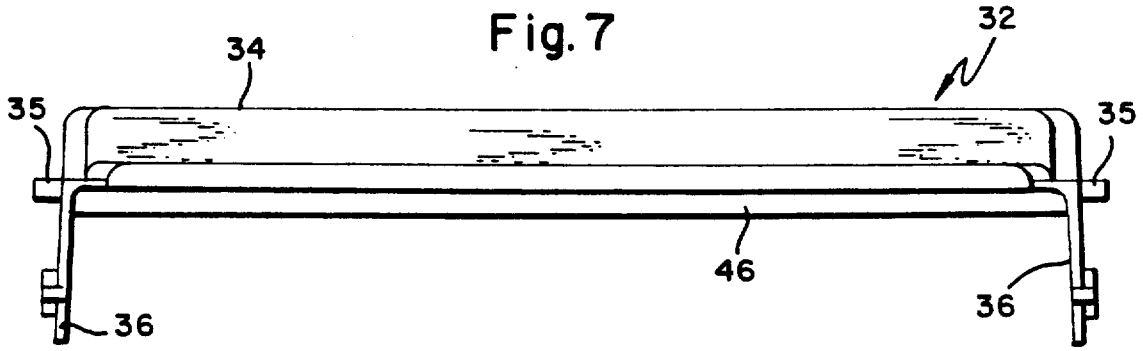
FIG. 7 is a front elevational view of the cover portion of the bin.
Figure 8:
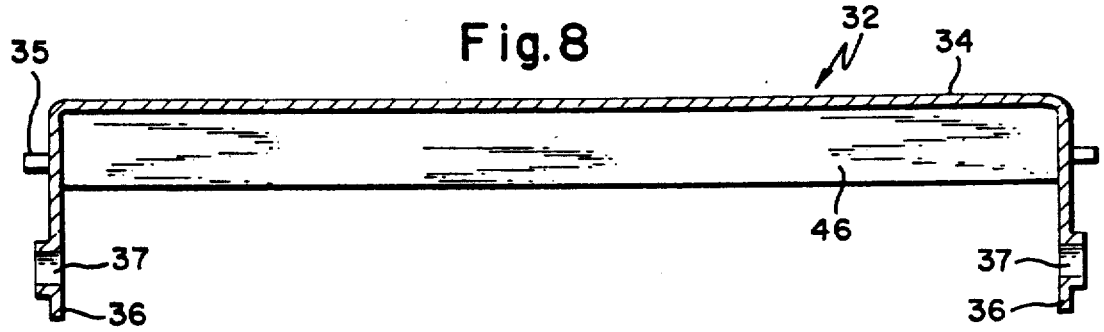
FIG. 8 is a vertical cross-sectional view of the cover portion of the bin taken along the line VIII—VIII of FIG. 4 and looking in the direction of the arrows.
Figure 9:
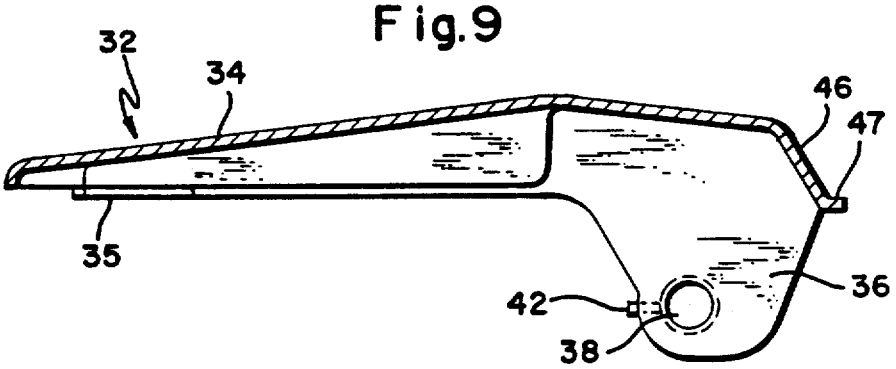
FIG. 9 is a vertical cross-sectional view of the cover portion of the bin taken along the line IX—IX of FIG. 5 and looking in the direction of the arrows.

The storage bin 10 includes a removable cover which is generally indicated by the reference numeral 32. The cover 32 comprises a flat top wall 34 and a pair of vertical side flanges which extend downwardly from opposite sides of the top wall 34. Each flange 36 has an aperture 37 for receiving a pivot pin 38 which extends from each of the side walls 18 and 20. The cover 32 is made of a flexible plastic material which enables the cover 32 to be removed from the pivot pin 38 by bending the flanges outwardly until the apertures 37 clear the ends of the pins. The cover 32 is reapplied to the pins 38 by spreading the flanges 36 so that they lie outside of the pins 38 and then aligning the apertures 37 axially with the pins 38 so that by releasing outward pressure on the flanges 36, the pins 38 enter into the apertures 37. The cover 32 has a pair of laterally extending tabs 35 which extend beyond the top edge 26 of the storage bin as shown in FIGS. 5 and 6. This enables the cover to be moved from the closed position as shown in FIG. 4 to the open position which is shown in FIG. 10.

The cover 32 is yieldably maintained in the closed position by a detent means on each side of the storage bin which are generally indicated by the reference numeral 40. Each detent means 40 comprises a first projecting finger on the flange 36 and a second projecting finger 44 on each of the side walls 18 and 20. The second projecting finger 44 extends forwardly. The first projecting finger extends rearwardly and is located below the second projecting finger 44 when the cover 32 is in the closed position as shown in FIG. 4. The fingers 42 and 44 are made of a flexible resilient material such as plastic so that when the cover 32 is moved from the closed position to the open position by providing a lifting force on one or both of the tabs 35 the fingers 42 are forced past the fingers 44. The detent means 40 normally provide sufficient resistance to the opening of the cover 32 to maintain the cover 32 in the closed position unless a sufficient predetermined upward force is applied to the tabs 35. The forward end of the cover 32 has a forward wall 46 which extends downwardly from the top wall 34. The lower edge of the wall 46 has a horizontal lip 47 which engages the front wall 16 of the bin when the cover 32 is moved to the open position as shown in FIG. 10. The lip 47 thereby functions as a stop means for the cover to determine the final open position of the cover as shown in FIG. 10. When the storage bin 10 is positioned in its normal operating position as shown in FIG. 10, the top opening 28 faces forwardly and upwardly and the cover 32 extends upwardly and forwardly at a right angle to the plane of the opening 28. The cover 32 thereby functions as a guide for trash which is thrown into the storage bin and also helps to prevent spillover of trash when the storage bin becomes nearly full of trash.

Figure 10:
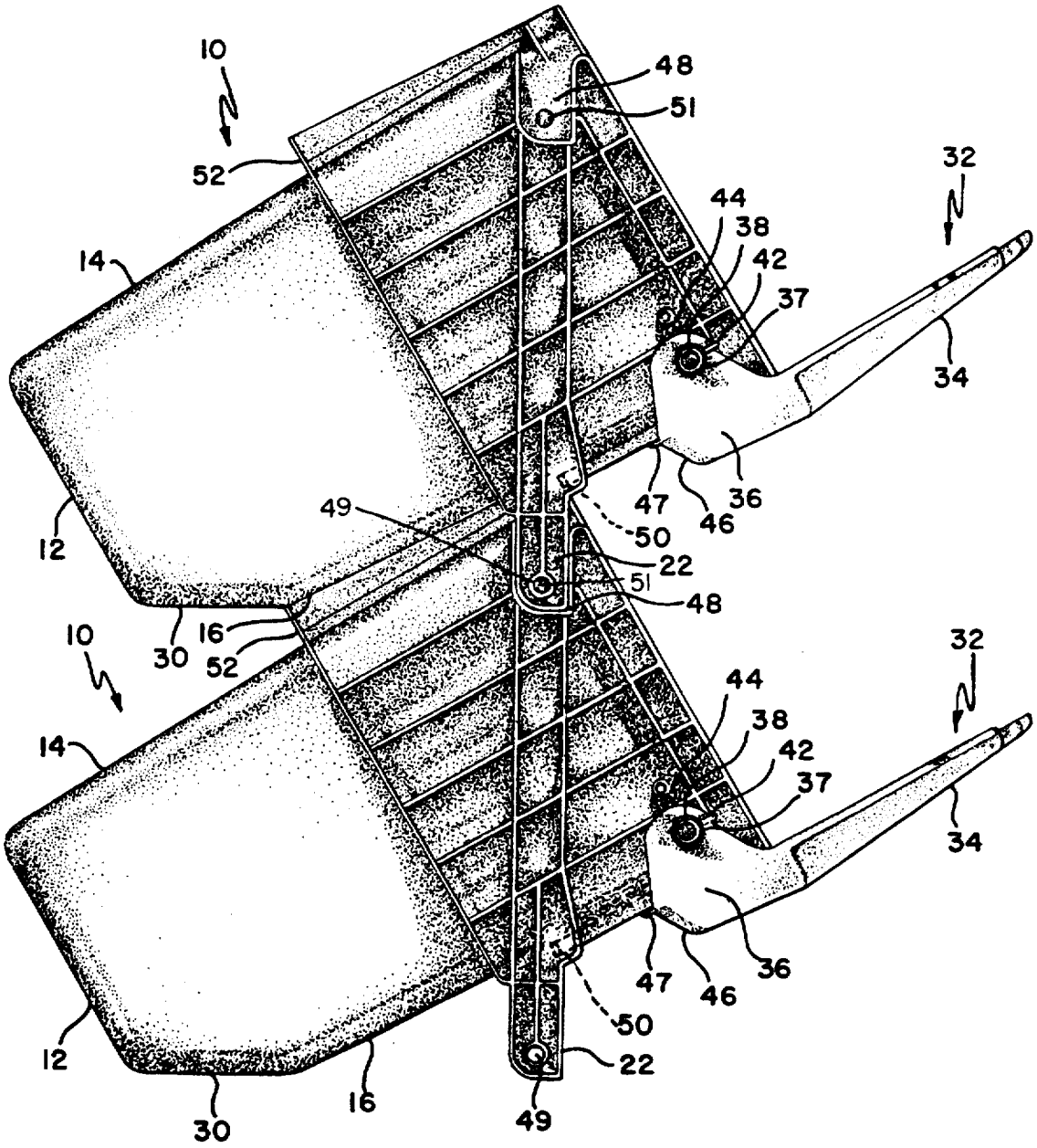
FIG. 10 is a left side elevational view of a pair of storage bins of the present invention shown in a stacked position with the cover portion of each bin shown in the open position.
Figure 11:
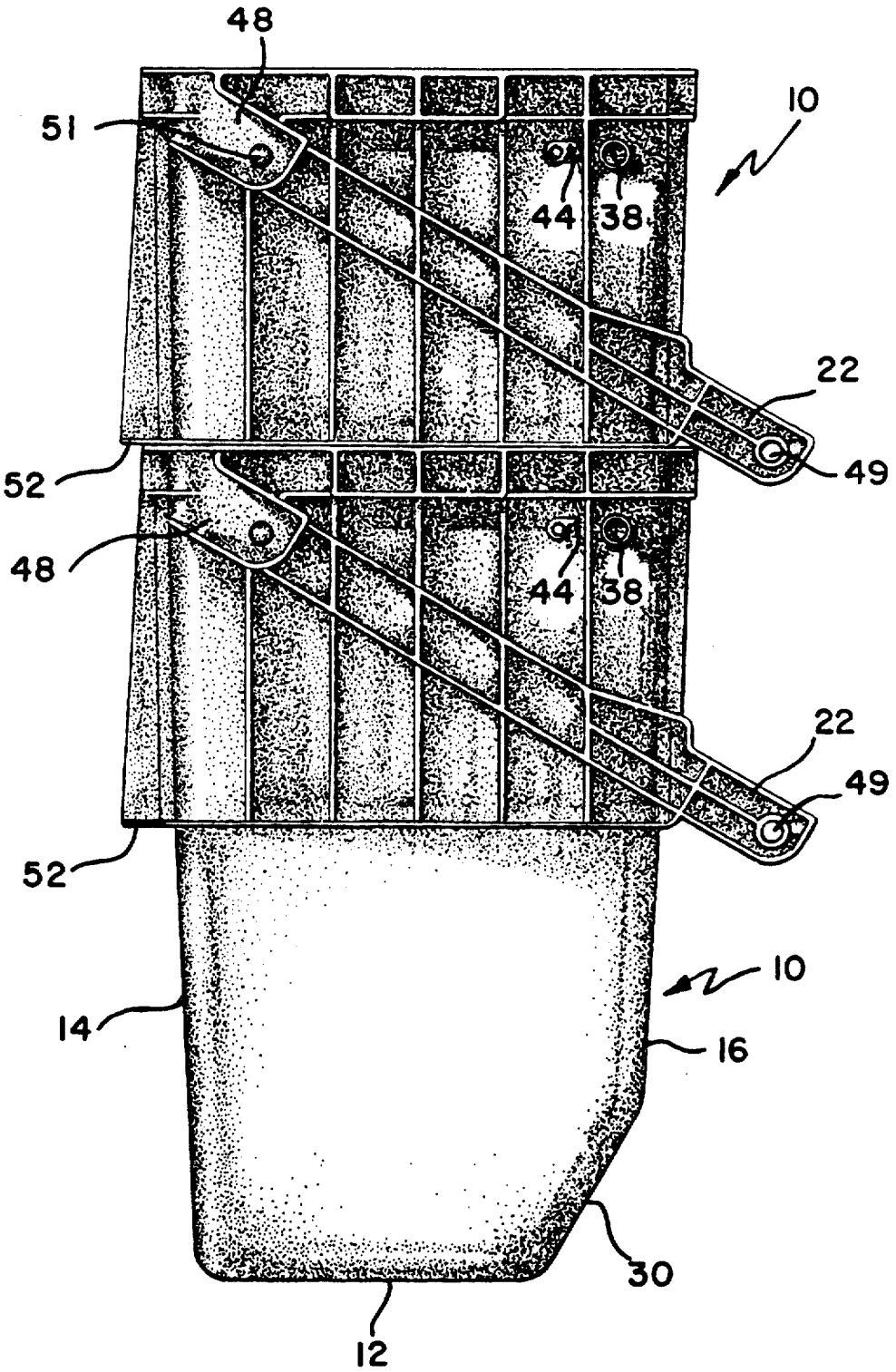
FIG. 11 is a left side elevational view of a pair of storage bins of the present invention shown in a nested position.

The upper rear corner of each side wall 18 and 20 is provided with an elongated groove 48 for receiving the leg of a second storage bin to enable the second storage bin to be stacked on top of the first storage bin as shown in FIG. 10. Each of the legs 22 and 24 has a circular hole 49. Each groove 48 has a rounded protuberance or button 51. When the legs 22 and 24 of the upper bin are inserted into the grooves 48, the buttons 51 snap into the holes 49 due to the resilient flexibility of the legs. The buttons 51 help to maintain the legs 22 and 24 in the fully inserted position within the grooves 48. The front wall of each storage bin is provided with a horizontal ridge 50 which is located just above the forwardly extending portions of the legs 22 and 24 so that when one storage bin is stacked on top of another storage bin, the lip 50 of the upper storage bin rests on the upper edge 26 of the lower storage bin for supporting most of the weight of the upper storage bin. Each storage bin 10 also has a horizontal ridge on the back wall 14 so that when one storage bin is stacked on top of another storage bin, the front wall 16 of the upper storage bin engages the ridge 52 of the lower storage bin. The grooves 48 are positioned so that when the legs 22 and 24 are inserted within a groove 48 the top edges of the upper and lower storage bins are located in parallel planes. Since the side walls of the storage bin are tapered, the front wall 16 of the upper bin is spaced from the rear wall 14 of the lower bin. The horizontal ridge 52 bridges this spacing and provides support for the front wall of the upper bin. When the bin 10 is nested within another bin as shown in FIG. 11, the ridge 52 of the upper bin engages the upper edge 26 of the lower bin to limit the depth at which one bin can be inserted into another bin. The front wall 16 is provided with a horizontal ridge 54 which is located just below the point where the legs 22 and 24 protrude from the front wall 16. The left wall 20 has a horizontal ridge 56 and the right wall 18 has a horizontal ridge 58. The ridges 52, 54, 56, and 58 all lie within the same horizontal plane when two more storage bins 10 are nested as shown in FIG. 11 for fully supporting the weight of the upper bin on the lower bin. The arms 22 and 24 extend freely above the line of support. In addition, the ridges 52, 54, 56, and 58 are positioned so that the upper storage bin does not completely bottom out within the lower storage bin. There is sufficient clearance between the side walls of the upper bin and the side walls of the lower bin to prevent jamming of the bins when nested and enabling the upper bin to be easily removed from the lower bin with no binding whatsoever.

Figure 1:
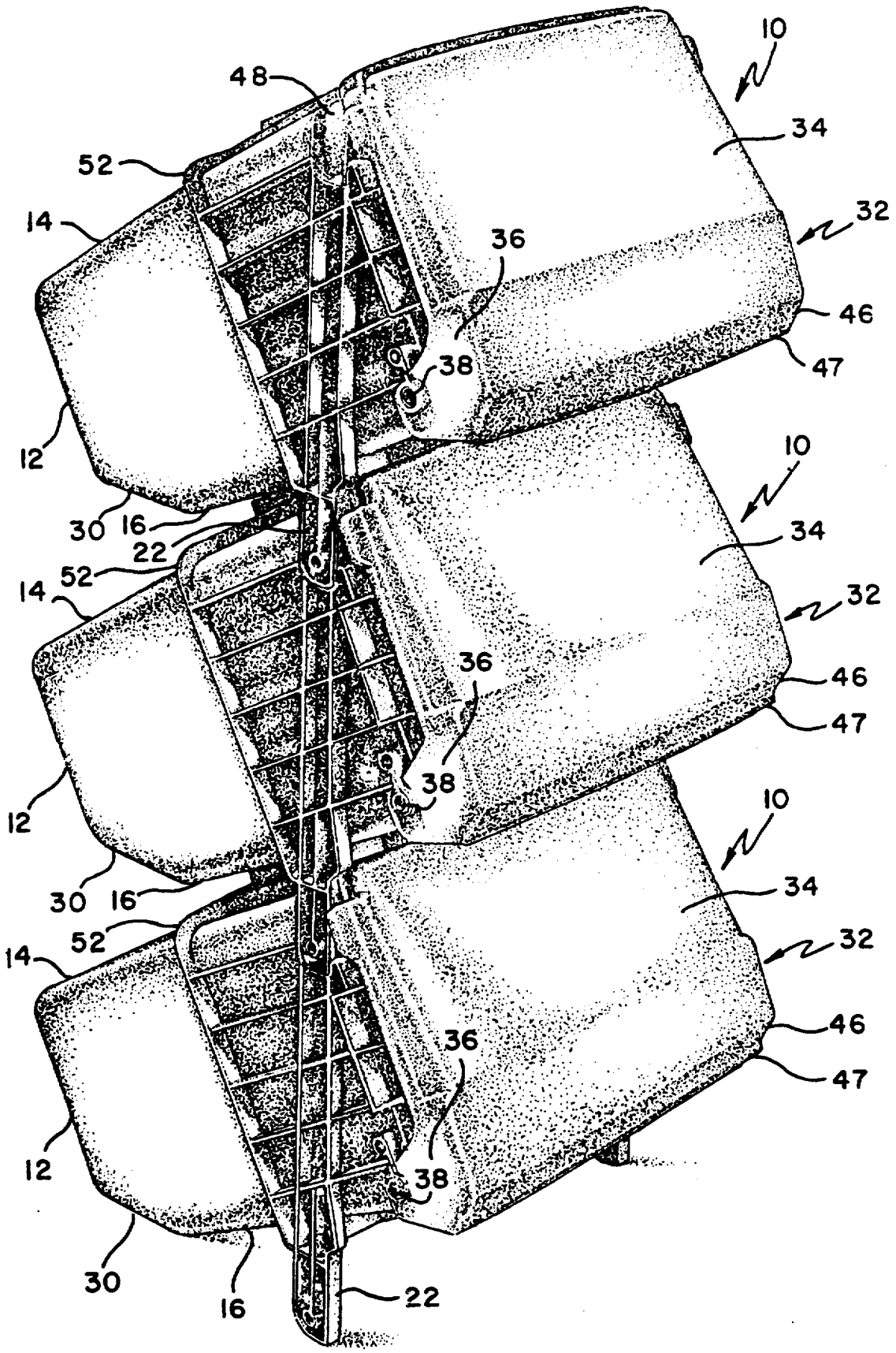
FIG. 1 is a perspective view of a stacking and nesting bin embodying the principles of the present invention shown in a stacked position with two additional identical storage bins.
Figure 2:
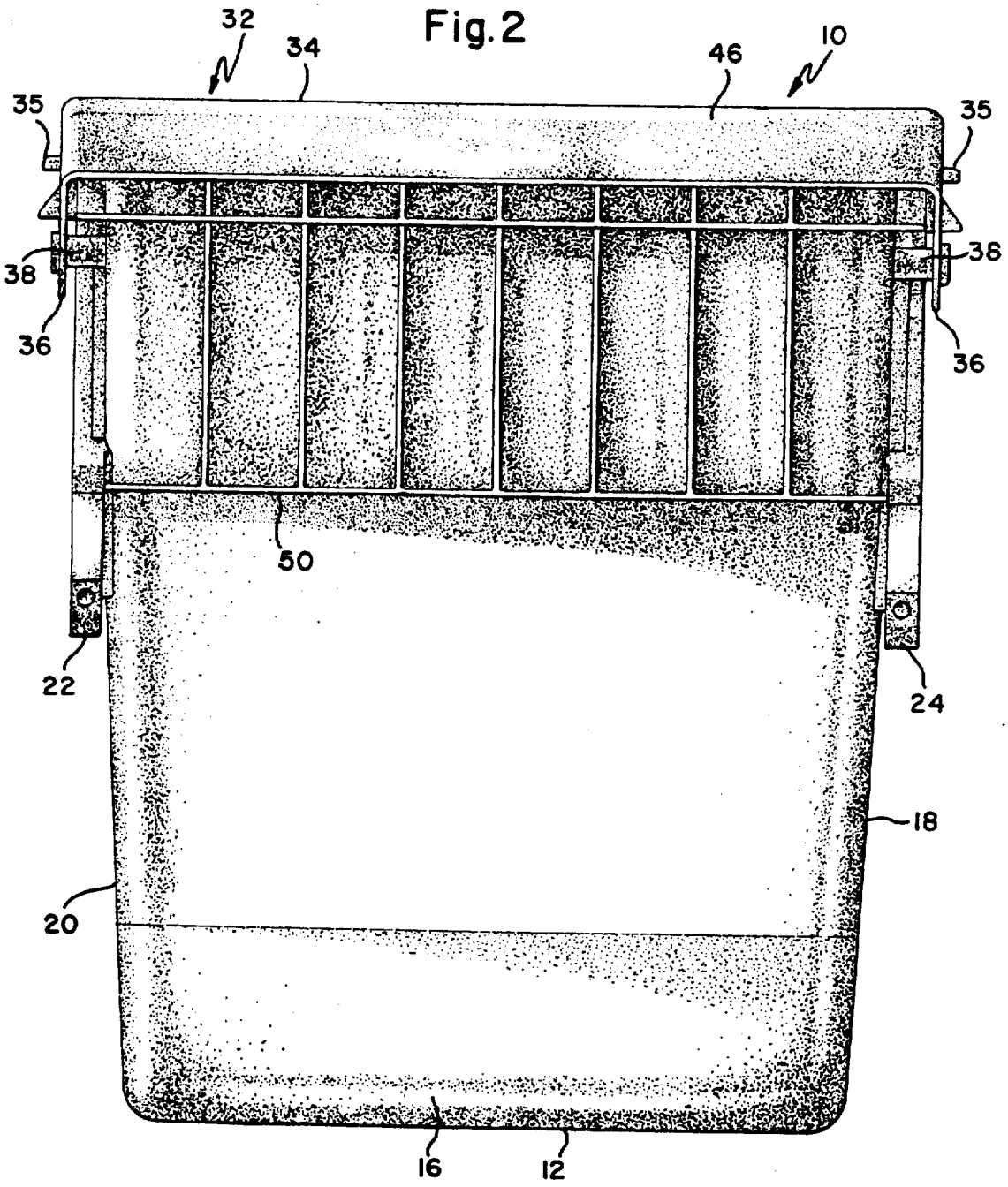
FIG. 2 is front elevational view of the bin.
Figure 3:
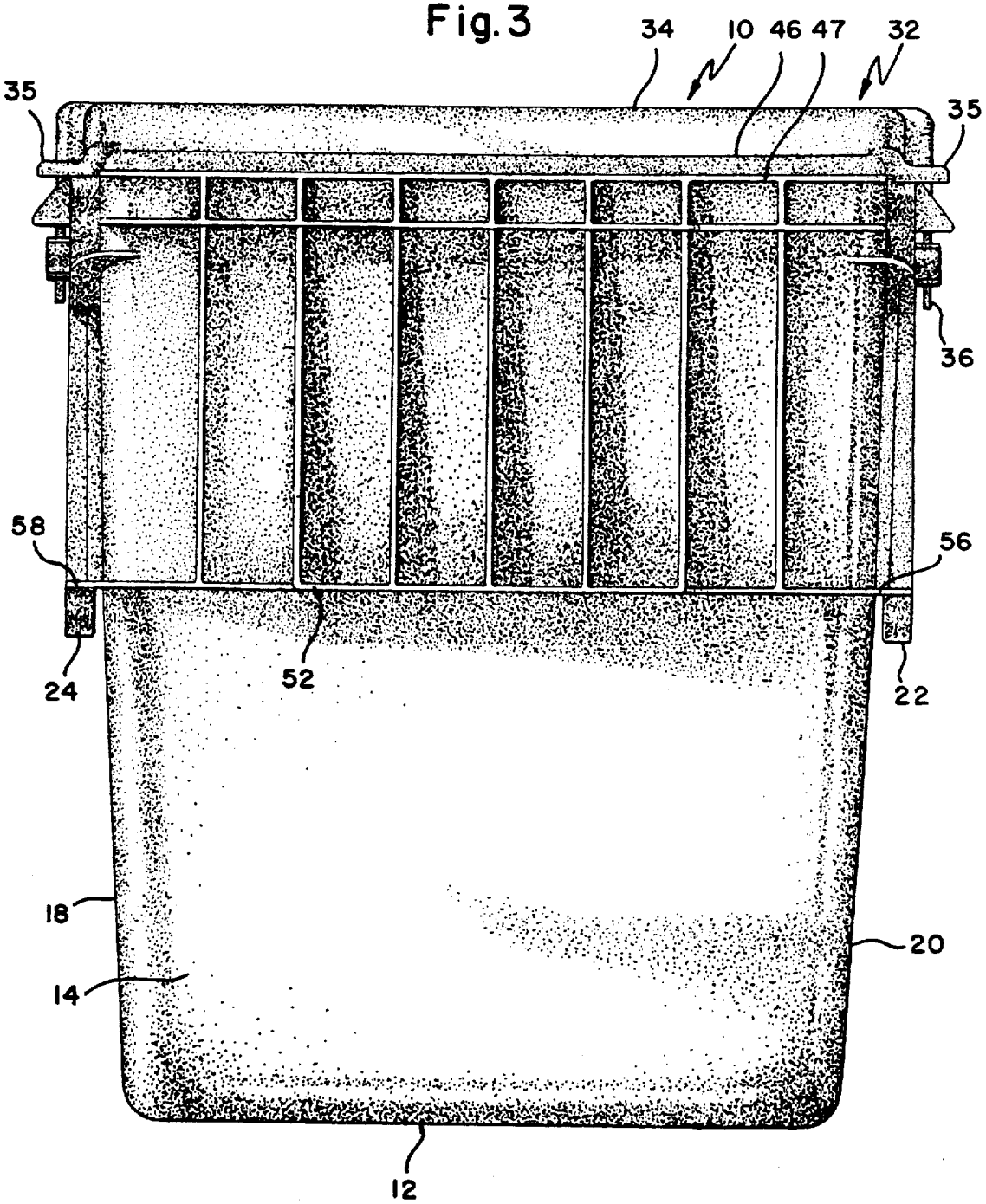
FIG. 3 is a rear elevational view of the bin.

The bin of the present invention can be utilized as a single bin but most of the advantages of the bin are realized by stacking two or more bins, the exact number of bins being left to the discretion of the user. Regardless of how many storage bins are employed in the stack, the stack itself extends vertically and is stable. A stack of bins requires the same amount of floor space as a single bin. The covers may be maintained in the closed position when not in use as shown in FIG. 1 and moved to the open position when the stack of bins is employed for sorting trash as shown in FIG. 10 or, if desired, the covers may be left in the open position. The opening 28 of each storage bin in the stack is clearly visible and accessible to a greater degree than for a plurality of conventional upright storage bins and requires only a fraction of the floor space which would be required for a plurality of individual bins. A plastic liner may be utilized for each storage bin which can be removed without any encumbrances after the liner has been filled with trash. Since the openings 28 face forwardly and upwardly, the contents of each bin are clearly visible to the user. This is very helpful if the storage bins are employed in a stack for sorting trash for recycling or for sorting cans and bottles at a redemption center. Due to the large number of brands which must be sorted at a redemption center, several stacks of the storage bins of the present invention may have to be employed but they will occupy less floor space than the conventional containers which are now being used. Also, due to the high visibility of the contents of each storage bin, the task of sorting the empty cans and bottles according to brand is greatly facilitated. The storage bins of the present invention can also be used for storing many types of items in the home in accordance to categories of items, thereby functioning as an organizer of materials. The storage bin of the present invention can also be used in a commercial setting for storing and displaying wares of different types. For example, a stack of storage bins of the present invention may be employed for displaying a particular type of wearing apparel wherein each bin contains a specific size. It seems clear from the examples given above that the potential uses for the storage bin of the present invention are virtually unlimited.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A storage bin comprising:

(a) a rectangular bottom wall, (b) a rectangular back wall, (c) a rectangular front wall, (d) a pair of legs which are fixed to the bin and which extend forwardly and downwardly relative to said front wall to free ends which enable said bin to be tipped forwardly so that the bin rests on said free ends and an edge area where said front and bottom walls intersects so that said top opening faces forwardly and upwardly, and (e) a pair of rectangular side walls, each of said back, front and side walls extending from said bottom wall and terminating in a rectangular top edge which defines a rectangular top opening, each of said side walls having an elongated groove which extends rearwardly and upwardly for receiving the legs of an identical second storage bin to enable a second of said storage bin to be stacked on top of and supported by a first of said storage bin.

2. A storage bin as recited in claim 1, wherein said edge area is truncated to form a flat edge surface between said front wall and said bottom walls.

3. A storage bin as recited in claim 1, wherein each of said storage bins has a horizontal ridge on the front wall of the bin so that when said second bin is supported on the first bin the ridge of said second bin rests on the top edge of the back wall of said first storage bin to provide additional support for said second bin on said first bin.

4. A storage bin as recited in claim 1, wherein the front, back, and side walls of said bin taper downwardly and inwardly so that said bin can be nested into a second identical storage bin, and the back wall of said first storage bins has a rearwardly extending ridge for supporting the front wall of said second storage b in so that the top edges of said first and second storage bins lie in parallel planes.

5. A storage bin as recited in claim 4, wherein said ridge is positioned so that when said bin is nested within a second identical bin, the ridge rests on said top edge so that there is clearance between said legs and the top edge and between the walls of one said bins relative to the walls of the other said bins.

6. A storage bin as recited in claim 5, wherein said ridge extends about the entire outer periphery of said storage bin.

7. A storage bin as recited in claim 1, wherein each of said legs is resilient and flexible, each of said grooves has a rounded protuberance, and each of said legs has a circular hole for receiving a corresponding one of said protuberances in a snap fit for releasably maintaining the legs in an inserted position in said grooves.

* * * * *